United States Patent [19]

Scott

[11] 3,936,697

[45] Feb. 3, 1976

[54] CHARGED PARTICLE BEAM SCANNING DEVICE

[75] Inventor: Warner Curtis Scott, Dallas, Tex.

[73] Assignee: Texas Instruments Incorporated, Dallas, Tex.

[22] Filed: Apr. 25, 1974

[21] Appl. No.: 463,934

[52] U.S. Cl. ..... 315/12 R; 313/300; 313/411; 313/495

[51] Int. Cl.[2] ..... H01J 29/41

[58] Field of Search ..... 315/10–12; 313/68, 411, 300, 495; 340/173 CR

[56] References Cited

UNITED STATES PATENTS

| | | | |
|---|---|---|---|
| 3,408,532 | 10/1968 | Hultberg et al. | 315/12 |
| 3,600,627 | 8/1971 | Goede | 315/12 |
| 3,803,443 | 4/1974 | Hant | 315/12 |

*Primary Examiner*—Richard A. Farley
*Assistant Examiner*—G. E. Montone
*Attorney, Agent, or Firm*—Harold Levine; James T. Comfort; Richard L. Donaldson

[57] ABSTRACT

A plurality of control plates is sandwiched between a cathode and a target to control the flow of charged particles such as electrons and ions between the cathode and the target. The cathode includes an elongated filament for generating charged particles such as electrons. A first electrode having a negative potential is positioned behind the filament with a second electrode having a positive potential interdigitated with the first electrode. Each control plate has a plurality of apertures formed therein which are effectively aligned with corresponding apertures on the other control plates. The aligned apertures form beam channels. The control plates have paired conductive electrodes thereon arranged at predetermined coded finger patterns. Voltages are selectively applied to the control plate electrodes by switching circuitry to focus the charged particles through the apertures associated with selective electrodes while simultaneously aborting the passage of charged particles through the apertures associated with the remaining electrodes. In this manner by selective switching control of the control plate a beam, or a plurality of beams, can be directed to a selected portion or portions of the target at the time.

9 Claims, 4 Drawing Figures

CHARGED PARTICLE BEAM SCANNING DEVICE

This invention is directed to a charged particle beam scanning device and more particularly to such a device which is responsive to a digital control signal.

This invention is an improvement over previous charge particle beam scanning devices such as that disclosed in U.S. Pat. No. 3,803,443. In such a device, a plurality of control plates are sandwiched between a cathode and a target to control the flow of charged particles such as electrons and ions between the cathode and the target. Each control plate has a plurality of apertures formed therein which are effectively aligned with corresponding apertures on the other control plates. The aligned apertures form beam channels. Control plates have paired conductive electrodes thereon arranged in predetermined coded finger patterns. Voltages are selectively applied to the control plate electrodes by means of switching circuitry to electrostatically focus the charged particles through the apertures associated with selected electrodes while simultaneously aborting the passage of charged particles through the apertures associated with the remaining electrodes. In this manner by selective switching control of the control plate, a beam or plurality of beams can be directed to a selected portion or portions of the target at a time. In another embodiment of an electron scanning device, such as that described in U.S. Pat. No. 3,408,532 flat dynode control plates are used in place of the electrostatic focusing with the flat dynode control plates sandwiched between a flat cathode and a flat target plate. In the device using the dynode control plates, the dynode control plates perform both control and electron multiplication functions. Such scanning devices are those described, have distinct advantages over cathode ray tube scanning devices of the prior art because of their compact configuration, high linearity and capability of response to randomly addressed digital control signals.

Such charged particle beam scanning devices have previously required large voltage swings on the control plates. Voltages required on the control, or switching plates as they may be termed, must be a high potential (typically 75 to 100 volts above the potential of the cathode). These high potentials are required for several reasons. Previous cathode designs such as that disclosed in U.S. Pat. No. 3,769,540 have required high current so that the cathode will emit electrons with good uniformity at the first switching plate. There must also be a sufficient current density of the electrons to permit a bright display on the phospor screen. This requires significantly high voltage between the cathode and the first switching plate to achieve both uniformity and a sufficiently bright display. When the current flood from the area cathode arrives at the first switching plate of the switching stack there is an attenuation of the electrons due to the geometrical shadowing effect on the switching plate. Electrons striking the holes go through the holes while those striking the area on the switching plate between the holes do not go through the holes. Previous designs of the charge particle beam scanning device have attacked the attenuation problem by putting a much higher potential on the second switching plate when the on condition is desired. This very high potential on the second switching plate will cause equipotential lines in front of the first switching plate to bulge out and form a positive electrostatic lens. This will draw in electrons which would have struck the periphery of the first switching plate holes and draw the electrons into and through the holes instead of allowing them to be lost when they strick the periphery around the holes. The problem in providing such a high potential is that so much kinetic energy is imparted to the electrons that very large voltage swings are required to turn them off. If an electron passes through any hole in the switching stack with a large value of electron volts of kinetic energy, then reduction by at least the same amount of electron volts is required to subsequently turn the electron flow off. Thus there is a necessarily high voltage swing in the switching plates to achieve a sufficiently bright display.

It is therefore an object of this invention to provide a new improved charged particle beam scanning device having lower switching voltages at the switching plates.

Another object of this invention is to provide a new and improved charged particle beam scanning device having uniform charge density of emitted electrons at the switching plates.

Another object of this invention is to provide a new and improved charged particle beam scanning device having reduced voltage swings at the switching plates.

Yet another object of this invention is to provide a new and improved charged particle beam scanning device having increased brightness.

Another object of this invention is to provide a new and improved charge particle beam scanning device having decreased cathode power requirements.

Figure 3:
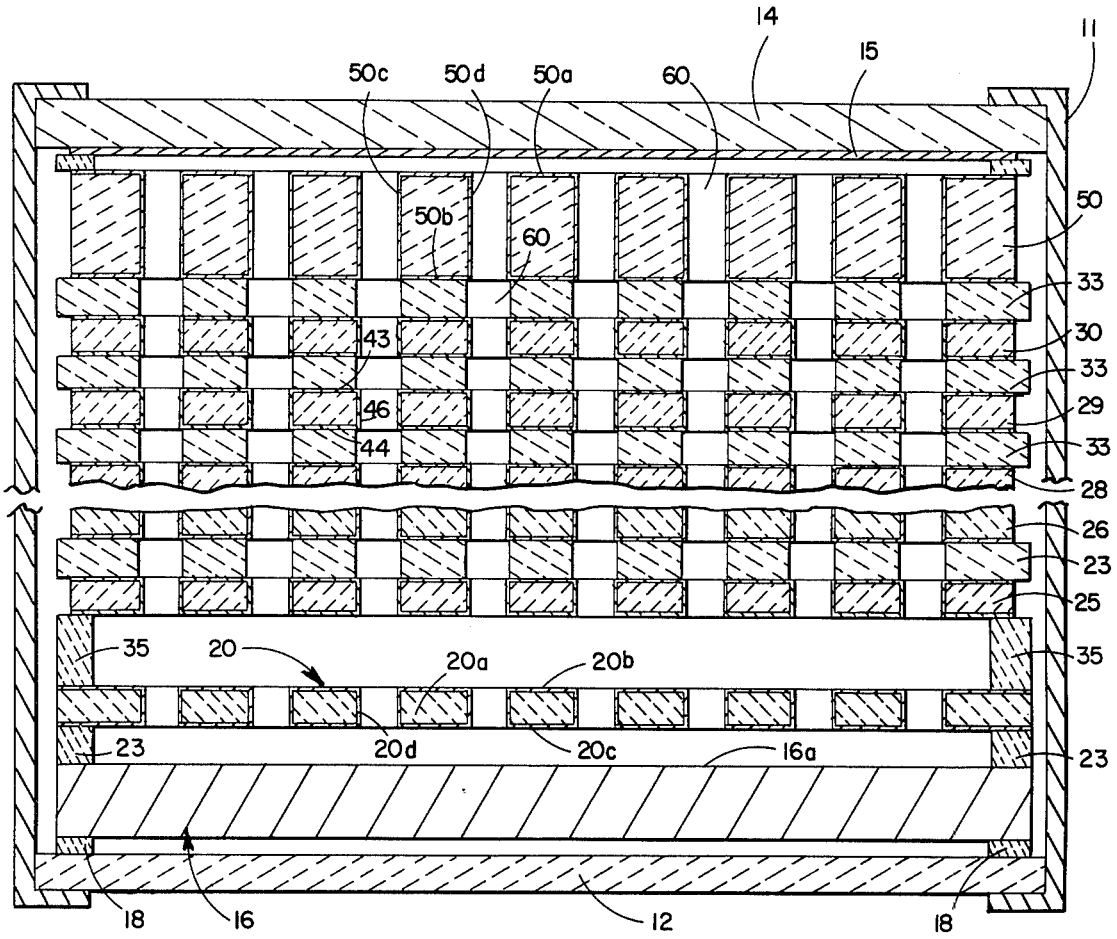
FIG. 3 is a cross-sectional view showing details of the electron beam channels of the embodiment of FIGS. 1 and 2.
Figure 2:
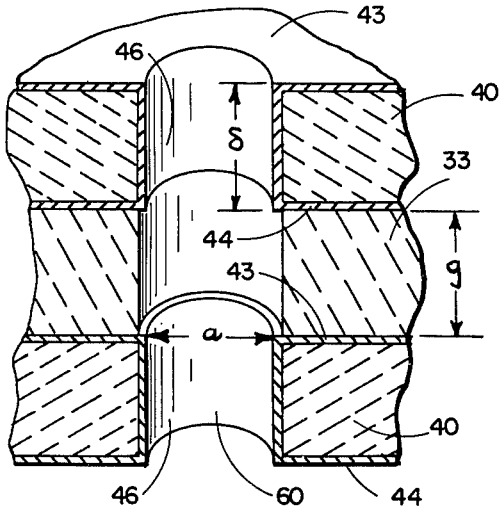
FIG. 2 is a cross-sectional view illustrating the construction of the embodiment shown in FIG. 1.

Referring now to FIGS. 2 and 3, cross-sectional views illustrating the structure of one embodiment of the device of the invention are shown. It is to be noted that for illustrative purposes, an 8×8 display is shown, but that in most practical implementations, a much greater number of channels would be utilized to provide a much higher definition display. A vacuum tight casing is formed by means of side frame member 11, ceramic plate 12, and glass front viewing plate 14. The casing so formed is evacuated so as to provide a vacuum environment for the components contained therein.

Figure 4:
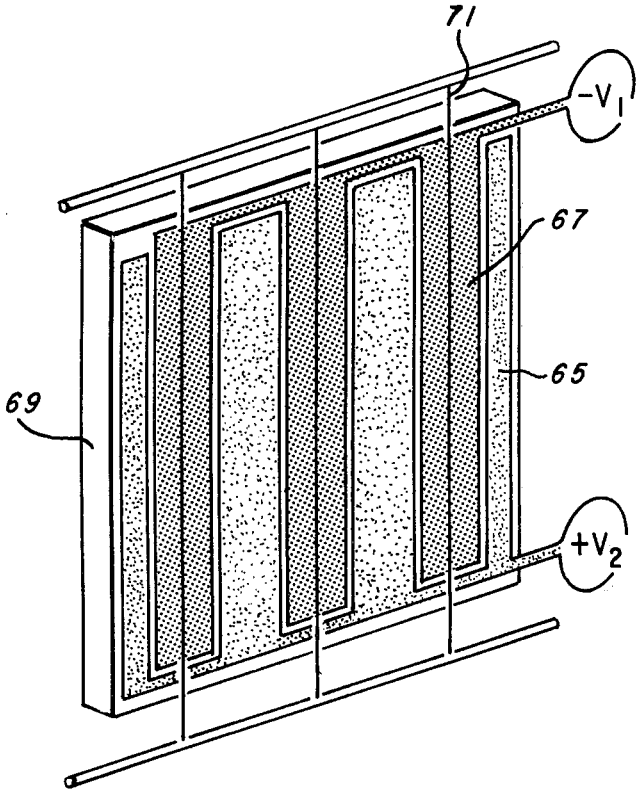
FIG. 4 shows the area cathode of the embodiment in more detail.

Cathode 16, which is shown in FIG. 4 in more detail, is supported along opposite edges thereof on bar members 18. Mounted directly opposite cathode 16 is electron lens plate 20, which is formed from a flat dielectric substrate **20*a* having overall metallic coatings 20*b* and 20*c* deposited on the opposite broad surfaces thereof and conductive coatings 20*d* on the walls of the apertures between the surfaces, coatings 20*d* electrically interconnecting coatings 20*b* and 20*c*. Electron lens plate 20 is separated from cathode 16 by means of insulator bars 23**.

Figure 1:
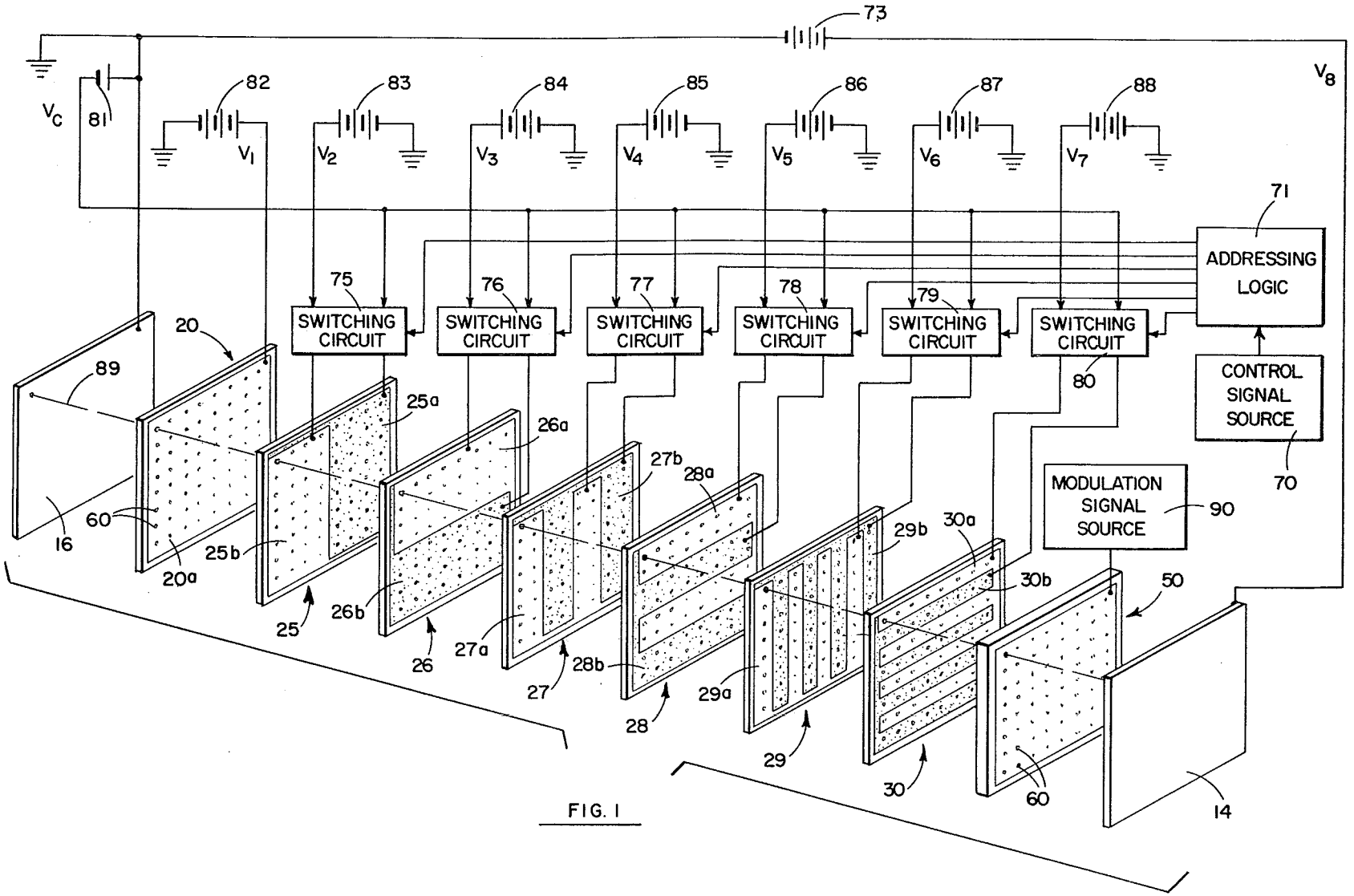
FIG. 1 is a schematic drawing of one embodiment of a charged particle beam scanning device.

Next in the stack are control or switching plates 25–30, which are insulatively separated from each other by means of insulator plates 33 which may be of a ceramic material. Plate 25 is separated from lens plate 20 by means of insulator spacer bars 35. As can best be seen in FIG. 2, the control plates are formed of a dielectric substrate 40 which may be of a material such as ceramic or glass, having similar electrodes 43 and 44 of a highly conductive material such as gold or copper deposited on the opposite surfaces thereof. The electrodes are arranged in predetermined finger patterns, as illustrated in FIG. 1, with the opposite electrodes 43 and 44 of each control plate having the same finger pattern arranged opposite each other in mirror image relationship. Electrodes 43 and 44 are electrically interconnected by means of coatings 46 which are deposited on the walls of the apertures extending between the opposite sides of the plates.

Mounted above control plate 30 and separated therefrom by an insulator plate 33 is modulator plate 50. Modulator plate 50 is similar in general construction to the control plates in that it includes electrodes 50*a* and 50*b* of a highly conductive material such as gold or copper on the opposite surfaces thereof, which are interconnected by conductive portions 50*c* deposited on the walls of the apertures of the plates, the conductive layers 50*a*–50*c* being deposited on dielectric substrate 50*d*. Modulator plate 50, however, differs from the control plates in that the electrodes 50*a* and 50*b* are not arranged in a finger pattern but are rather deposited over the entire surface areas of the plate. Also, in the modulator plate, as can be noted in the drawing, the length of the apertures is substantially greater than that of the control plate, the choice of length to diameter ratio being designed to provide less abrupt cut-off characteristics to facilitate the handling of a modulation signal.

All of the various plates just described have a plurality of apertures 60 formed therein, corresponding apertures of successive plates being aligned with each other to form electron beam channels between cathode 16 and phosphor target 15 on plate 14.

Electron lens plate 20 and modulator plate 50 are not essential for the basic operation of the device, and an electron beam can be addressed to the target from the cathode in response to digital control signals without these particular plates. However, each one affords a special function which may be needed for a particular application requirement. Thus, the modulator plate 50 enables the intensity modulation of the beam where this may be called for, while the electron lens plate provides for increased input current which will contribute to higher intensity of the display.

Referring now to FIG. 1, the device of the invention is schematically illustrated. Each of control plates 25–30 has a pair of electrodes 25*a*, 25*b*–30*a*, 30*b*, on each of the opposite surfaces thereof. Thus, the electrodes on the opposite surfaces which are not shown are mirror images of the electrodes which are shown in the Figure. The electrodes are of a highly conductive material such as gold or copper, and each electrode 25*a*–30*a* is electrically insulated from its paired electrode 25*b*–30*b* respectively. As already explained in connection with FIGS. 2 and 3, the electrodes on opposite surfaces are electrically interconnected with each other by means of conductive coatings which may be of the same material as the electrodes on the walls of the apertures extending therebetween.

Digital control signals are fed from control signal source 70 to addressing logic 71 which provides an appropriate control signal to each of switching circuits 75–80. Switching circuits 75–80 may be electronic switching circuits such as flipflops, capable of alternatively connecting the voltages fed thereto to either one or the other of the paired electrodes of the particular control plate associated therewith in response to the addressing logic. Voltages are applied to switching circuits 75–80 for use in controlling the electrodes from power sources 83–88 respectively. A beam accelerating voltage is applied between cathode 16 and target 14 from voltage source 73. Switching circuits 75–80 receive first voltages $V_2$–$V_7$ from power sources 83–88 respectively, which are positive voltage with respect to ground, and a second voltage, $V_c$, which is a negative voltage with respect to ground.

The switching circuits in response to addressing logic 71 alternatively connect $V_2$–$V_7$ as the case may be, to one of the paired electrodes of each control plate and $V_c$ to the other paired electrode. For illustrative purposes, all of the electrodes receiving the voltage $V_c$ are shown stippled, while those receiving $V_2$–$V_7$ are shown without stippling. Under such conditions a beam of electrons are indicated by line 89 will pass through only a single channel formed by the plate apertures, the flow of electrons being blocked through all other channels by virtue of the effect of a cut-off voltage $V_c$, appearing somewhere in each of these other channels.

Thus, by selective switching control of plates 25–30, the electron beam can be controlled so that it excites a single elemental portion of target 14 at a time. The control is effected by virtue of the electrostatic focusing, achieved by means of the electron lenses formed between electrode portions of successive plates having the potentials $V_2$–$V_7$ applied thereto. The channels associated with the electrodes having the voltage $V_c$ applied thereto are cut off, the electrons being repelled in these channels and drawn off by the electrodes.

Lens plate 20, which is utilized to increase the current, is generally similar in construction to control plates 25–30 and has overall conductive coatings 20*b* and 20*c* on the opposite sides thereof, these coatings being electrically connected to each other by conductive coatings 20*d* in the aperture walls (see FIG. 3). Voltage $V_1$ is applied to the conductive coatings 20*b*–20*d*. Modulation plate 50 may be used to intensity modulate the signal in response to a modulation signal source 90. Modulation plate 50 is generally similar in construction to control plates 25–30, having similar electrodes on each of the opposite broad surfaces thereof, with conductive coatings on the walls of aperture 60 electrically interconnecting said surface. Modulation plate 50, however, is generally designed with a substantially greater thickness so that it has longer aperture than the control plates so as to provide less abrupt cut-off characteristics to suitably accommodate modulation signals having a reasonable dynamic range.

It is to be noted that while the device of the invention has been described in connection with the control of an electron beam, it can be utilized to equal advantage in the control of beams formed from other types of charged particles such as positive or negative ions.

The area cathode 16 is shown in more detail in FIG. 4. Two interdigitated electrodes 65 and 67 are formed on the back plate 69. Electrode 67 is connected to a negative potential and electrode 65 is connected to a positive potential. A plurality of filament wires 71 are suspended in front of the area cathode 16 with each filament wire 71 positioned in front of the electrode 67 having a negative potential. The filament wires 71 are connected to a ground potential power source to heat the filament wires 71 to cause emission of electrons therefrom. Electrodes 65 and 67 may be evaporated directly on the backplate 69, and insulated from each other.

When the filament wires are heated electrons are emitted towards the lens plate 20. The electrons are uniformly emitted with sufficient current density towards the lens plate to provide good brightness.

In FIG. 4 only 3 filament wires are shown. The area cathode actually has a plurality of filament wires, with each filament wire positioned in front one finger of electrode 67.

The forward and sideways electric fields from the electrodes 65 and 67 in the vicinity of the filament wires 71 achieves a forward and spreading set of electron trajectories from the filament wires.

There is little or no electron emission in the backward direction toward the plate 69 so that the power required for the area cathode is reduced. There is sufficient uniformity of current density of the emitted electrons to allow the distance from the filament wires to the lens plate to be small. This also reduces required cathode power. There is also sufficient forward current density at the first switching plate 25 so that the potential applied to that switching plate 25 may be relatively small as contrasted with previous designs.

The area cathode 16 is broadly an area source of charged particles. The charged particles may be other than electrons such as positive or negative ions. When charged particles other than electrons are emitted, an elongated source of such particles should be used instead of the filament wires.

I claim:

1. A charged particle beam scanning device comprising:

an area source of charged particles for providing a uniform flow of charged particles over a predetermined area, said area source including elongated charged particle generating means for generating charged particles, a first electrode having a negative potential, positioned behind said generating means, and a second electrode having a positive potential interdigitated with said first electrode an area target, a plurality of control plates sandwiched between said source and said target for controlling the flow of charged particles therebetween, each of said control plates having a plurality of apertures formed therein, corresponding apertures of said control plates being aligned to form charged particles beam channels between the source and the target, said control plates each having a plurality of electrodes on at least one of the surfaces thereof, said electrodes on each of said surfaces being electrically insulated from each other, means for providing potentials to at least one of the electrodes of each successive control plate to focus said charged particles through selected control plate apertures, and means for providing a cutoff potential to the remaining electrodes of said control plates, whereby a beam of charged particles is focused by said focusing potentials through the channels formed by said selected apertures.

2. The charged particle beam scanning device claimed in claim 1 wherein said elongated particle generating means in said area source is a elongated filament.

3. The charged particle beam scanning device claimed in claim 2 wherein said area source of charged particles includes a flat dish on which said first and second interdigitated electrodes are positioned.

4. The charged particle beam scanning device claimed in claim 3, wherein the filament means in the area source of charged particle includes a plurality.

5. The charged particle beam scanning device claimed in claim 4 including a power source connected to said filament means for generating electrons from said area source.

6. The charged particle beam scanning device claimed in claim 1, wherein said electrodes are arranged in a binary coded finger pattern.

7. The charged particle beam scanning device claimed in claim 6, wherein said control plates comprise a dielectric substrate, said electrodes being deposited on said substrate.

8. An electron beam scanning device comprising;

an electron flood gun for providing a uniform flow of electrons over a predetermined area, said electron flood gun including a flat dish, a first electrode having a negative potential on said flat dish, a plurality of elongated filaments for generating electrons positioned in front of said first electrode, and a second electrode having a positive potential on said flat dish interdigitated with said second electrode, an area target, a plurality of control plates sandwiched between said source and said target for controlling the flow of electron therebetween, each of said control plates having a plurality of apertures formed therein, corresponding apertures of said control plates being aligned to form electron beam channels between the source and the target, said control plates each having a plurality of electrodes on at least one of the surfaces thereof, said electrodes on each of said surfaces being electrically insulated from each other, means for providing potentials to at least one of the electrodes of each successive control plate to focus said electrons through selected control plate apertures, and means for providing a cutoff potential to the remaining electrodes of said control plates, whereby a beam of electrons is focused by said focusing potentials through the channels formed by said selected apertures.

9. An electron beam scanning device comprising;

an electron flood gun for providing a uniform flow of electrons over a predetermined area, said electron flood gun including a flat plate, a first electrode positioned on said flat plate, said first electrode formed in a series of elongated parallel fingers, a second electrode positioned on said flat plate insulated from said first electrode, said second electrode formed in a series of parallel fingers interdigitated with said first electrode, a plurality of elongated filaments for generating electrons, positioned in front of each finger of said first electrode, means for applying a negative potential to each of the fingers of said first electrode and a positive potential each finger of said second electrode, an area target, a plurality of control plates sandwiched between said source and said target for controlling the flow of electrons therebetwee, each of said control plates having a plurality of apertures formed therein, corresponding apertures of said control plates being aligned to form electron beam channels between the source and the target, said control plates each having a plurality of electrodes on at least one of the surfaces thereof, said electrodes on each of said surfaces being electrically insulated from each other, means for providing potentials to at least one of the electrodes of each successive control plate to focus said electrons through selected control plate apertures, and means for providing a cutoff potential to the remaining electrodes of said control plates, whereby a beam of electrons is focused by said focusing potentials through the channels formed by said selected apertures.

* * * * *